United States Patent [19]

Grenon

[11] Patent Number: 4,561,349

[45] Date of Patent: Dec. 31, 1985

[54] VARIABLE LENGTH GUIDE DEVICE FOR A PUSHED WIRE

[76] Inventor: René E. Grenon, 21, rue Victor Hugo, 77181 Courtry, France

[21] Appl. No.: 681,864

[22] PCT Filed: Mar. 15, 1984

[86] PCT No.: PCT/FR84/00063

§ 371 Date: Nov. 13, 1984

§ 102(e) Date: Nov. 13, 1984

[87] PCT Pub. No.: WO84/03681

PCT Pub. Date: Sep. 27, 1984

[30] Foreign Application Priority Data

Mar. 16, 1983 [FR] France ..... 83 04304

[51] Int. Cl.[4] ..... B65B 13/04

[52] U.S. Cl. ..... 100/26; 53/589

[58] Field of Search ..... 100/25, 26, 31; 53/589

[56] References Cited

U.S. PATENT DOCUMENTS 2,959,118 11/1960 Hager ..... 100/26
3,613,557 10/1971 Coleman ..... 100/26

FOREIGN PATENT DOCUMENTS 1275891 10/1961 France .
1306631 9/1962 France .
2133078 11/1972 France .
2480255 10/1981 France .
2502582 10/1982 France .

*Primary Examiner*—Billy J. Wilhite
*Attorney, Agent, or Firm*—Cushman, Darby & Cushman

[57] ABSTRACT

A guide device comprises two portions (3A, 3B) each having two branches (6A$_1$-6A$_2$, 6B$_1$-6B$_2$) having internal faces (5A, 5B) that slide over each other and in which successive lengths (4A to 4E) of a guide channel (4) are alternately hollowed out and interconnected by slopes (14, 15) so that the central opening (9) can be closed exactly, lengthwise, over articles to be bound (1).

5 Claims, 6 Drawing Figures

VARIABLE LENGTH GUIDE DEVICE FOR A PUSHED WIRE

The invention relates to a device for guiding relatively rigid wire being pushed along a path whose length varies according to requirements, which path is closed within the assembly.

There exists a need for a device of this type in a baling or binding machine in which a single bundle is made of a plurality of articles that are pressed together by a metal wire. The two free ends of the wire surrounding the articles in question are twisted together in a twist joint to constitute a splice. The splice serves to keep the wire taut over the articles and to fold over the two end portions of the wire in a shape that is rounded overall and is unlikely to cause injury.

The splice is made by means of a head (which does not form part of the present invention) which cuts the wires to the required length, puts them under tension, and then twists together the two end portions.

The wire comes from a reel of wire from which it is unwound, pushed into a first channel through the binder head, and guided around the articles to be bound together. Then it passes back through a second channel in the binder head, and finally it is cut, put under tension and twisted as said above.

The present invention provides a device for guiding the wire around the articles to be bound between the wire leaving the binder head and its returning therein. The path to be followed by the wire is substantially closed on itself; it follows a circuit which is substantially the same as the outline of the right cross section of the articles to be bound. This outline may be circular; but more often it is oblong with straight portions that are interconnected by semicircular portions. Binding is often used to hold together the various turns of coils of metal wire, and the thickness or size of the coil varies with changing length and with changing differences between the inside diameter and the outside diameter of the coil. This leads to considerable modifications in the lengths of the straight portions of the oblong path followed by the binder wire, which path forms a closed loop having two sides that are not in the same plane.

Up to now, in existing binder machines, a wire guide has been used which has the desired shape but which is of constant length. The wire frequently constitutes too big a loop around the articles to be bound. It is thus essential, prior to twisting the wire, to reduce its length by pulling it backwards. This requires reversible type wire propelling means together with a store for receiving excess wire. In addition, during this operation, the wire slides over the articles to be bound and runs the risk of leaving undesirable rub marks thereon.

The main aim of the invention is to provide a binder wire guide device capable of giving just the right length of the wire the desired configuration around the articles to be bound, thus avoiding the need to take back any excess length at all.

A guide device in accordance with the invention is analogous to a plate divided into a first portion and a second portion which portions are applied against each other on either side of a median join plane parallel to the main opposite faces of the plate. A guide channel is hollowed in the internal contacting faces of the the two portions, said channel running between an inlet channel open to the exterior and an outlet channel which is also open to the exterior. A central opening is provided in the device, inside the path of the guide channel for receiving the articles to be bound.

The two portions are movable and may be moved apart from each other relative to the join plane to release the loop of wire from the guide device.

Further, the device may be opened to receive the articles to be bound by virtue of the fact that each of the two portions is generally U-shaped having two spaced apart parallel branches. When the two portions are joined together, the branches of each of them point towards the branches of the other from respective opposite junction zones. The two portions move by sliding their internal faces over each other on either side of the join plane and in the long direction of the branches. The central opening has two opposite curved ends, each of which forms that part of a respective one of the portions where the branches thereof are joined. The opening also has two parallel sides each of which is constituted by two joined branches, one from each portion. The relative position of the two portions over each other may be varied between a first extreme position in which the central opening is constituted by two matching semicircles and a second extreme position in which the central opening is constituted by the said semicircles spaced apart from each other and extended by the branches thereby giving a highly elongate oblong central opening having two opposite straight sides which are interconnected at their ends by the two semicircles.

The guide channel is hollowed alternately out from one and then the other of the internal faces of the two portions. In the semicircular ends, the guide channel is itself semicircular, it is in the junction between the branches of the portion in which it is situated, and it is open towards the inside of the central opening. In the straight sides, i.e. in the branches, the guide channel is spaced away from the central opening and on one side it is hollowed out from a branch of one of the portions, while on the other side it is hollowed out from a branch of the other portion. A slope is provided at the distant end (in the direction of binder wire movement) of each of the semicircular sides of the guide channel to connect each semicircular side to the straight side which runs on therefrom and which is hollowed out in a branch of the opposite portion.

There follows a description of an embodiment given without limiting intention and without excluding any variant. Reference is made to the accompanying drawings, in which.

Figure 6:
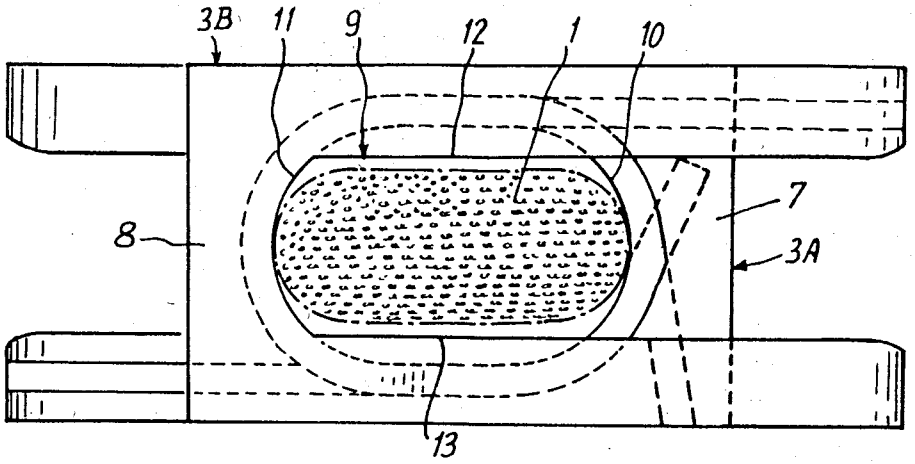
Figure 5:
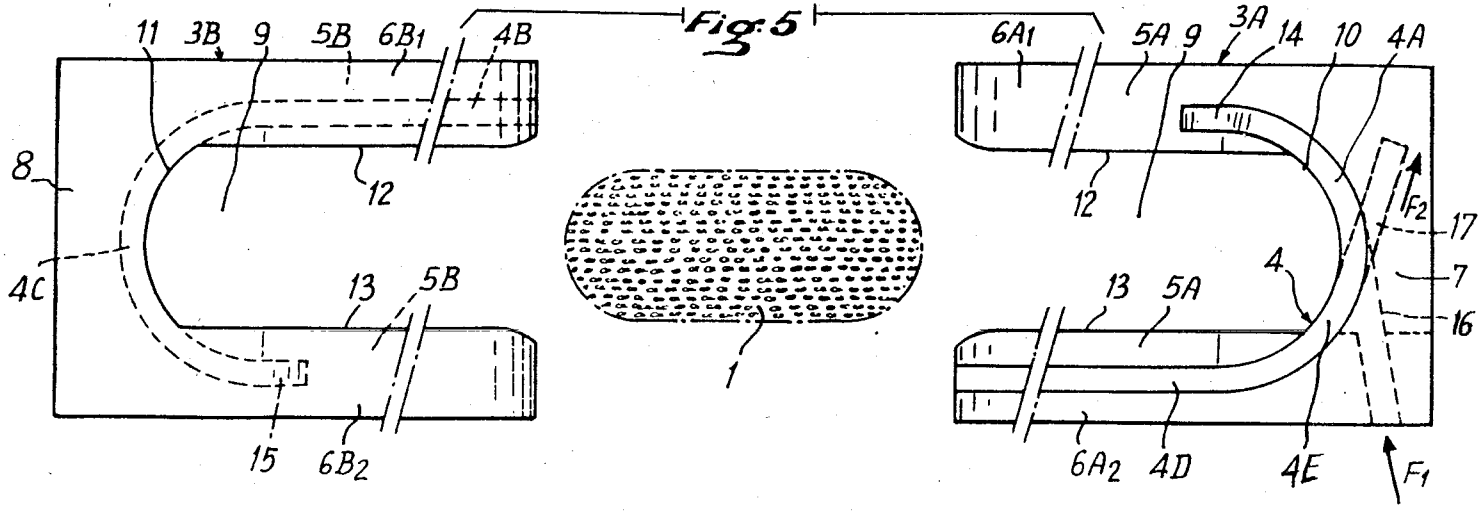

In FIG. 5 is a side view of a device in accordance with the invention in the open state around articles to be bound; and FIG. 6 is a side view of the FIG. 5 device in the closed state around the same articles, immediately prior to the binding operation.

Figure 1:
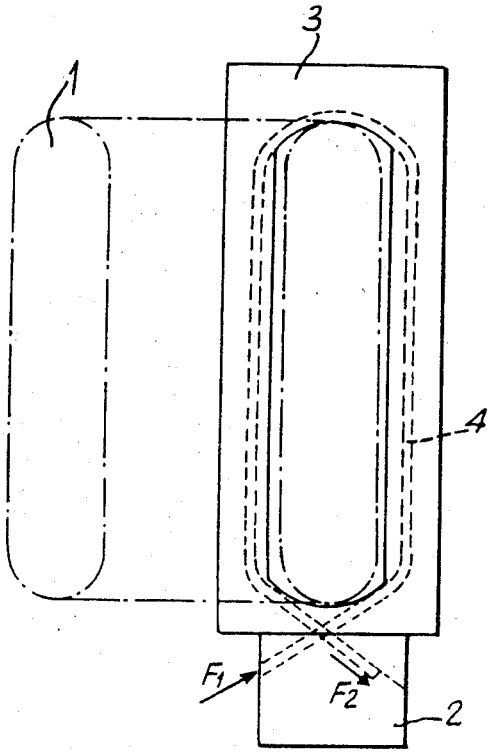
FIG. 1 is a diagrammatic view showing how a guide device is placed in association with a binder head.
Figure 2:
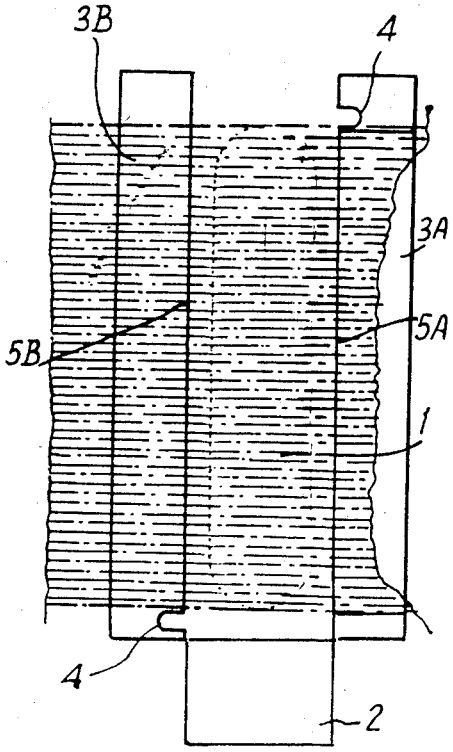
FIG. 2 is a view analogous to FIG. 1 but shifted through 90°.

FIGS. 1 and 2 use a dot-dashed line to represent a coil 1 of wires which is in the form of an annular cylinder and which is to be bound in several planes. The coil is placed in a binder machine which is represented solely by its binder head 2 through which a binder wire for surrounding a section of the coil 1 is pushed in the direction of an arrow $F_1$. To this end, a guide device 3 surrounds the section of the coil to guide the wire through a guide channel 4 and to bring it back to the binder head as indicated by an arrow $F_2$. The guide device 3 is analogous to a plate: it comprises a first portion 3A and a second portion 3B which are separate from each other on opposite sides of a join plane parallel to the opposite exterior major faces of the plate. When the two portions are together, their respective internal faces 5A, 5B in which the guide channel 4 is hollowed out make contact with each other in the join plane. FIG. 2 shows that once the binder wire surrounds the article to be bound, the wire can be released to allow the binder head 2 to make the splice by moving the two portions 3A, 3B away from each other to open up the guide device.

Figure 3:
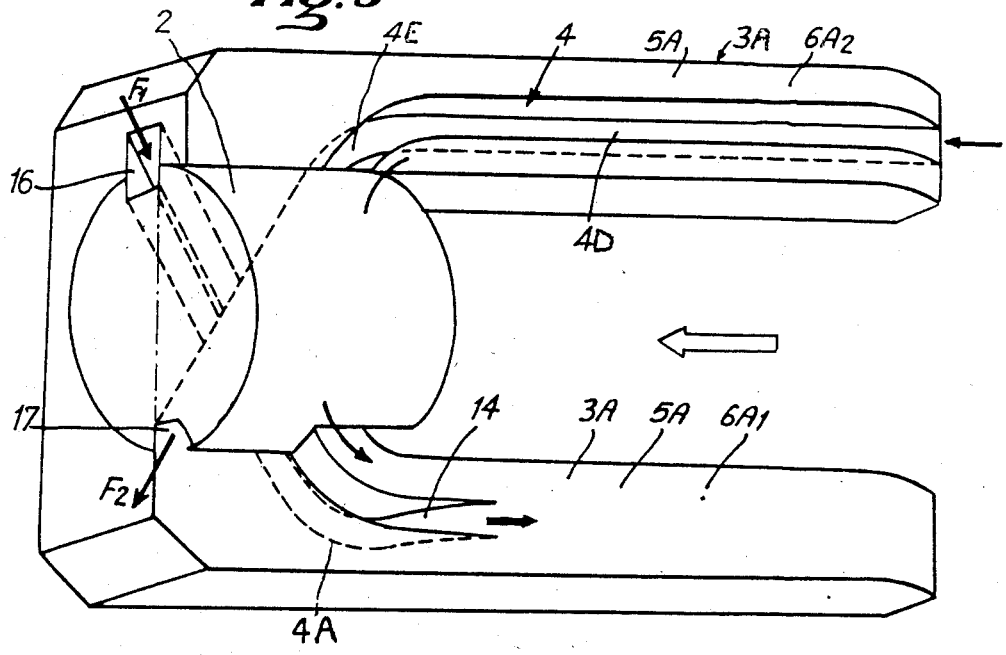
FIGS. 3 and 4 are perspective views which are closer to reality and which show the internal face of a first portion of the guide device in association with a binder head, and the second portion of the said device turned over to show its internal face.

FIGS. 1 and 2 are highly diagrammatic: they show a binder head 2 which is distinct and situated outside the guide device 3. In practice it is preferable to integrate the binder head 2 in the guide device 3 as shown in FIG. 3, whereby the internal channels of the head 2 become a part of the guide channel 4, thereby reducing the length of binder wire that is put into place before the splice is formed.

Although it is integrated in the guide device 3, the binder head 2 remains independent in that it must be able to rotate about itself in order to twist together the free ends of the binder wire. Prior to twisting, the binder wire forms a loop whose two ends cross, preferably spaced apart by a distance equal to the diameter of the wire. A detailed description of such a binder head is to be found in French Pat. No. 81-06106. The binder head has been omitted from FIGS. 5 and 6 in order to simplify the drawing.

In order to enable the coil 1 (or any other article to be bound) to be inserted inside the guide device, each of the portions 3A and 3B is U-shaped having two spaced apart branches $6A_1$ and $6A_2$ for the first portion 3A and $6B_1$ and $6B_2$ for the second portion 3B. These branches point towards one another from their respective junction zones 7 and 8.

When the two portions 3A and 3B are spaced apart from each other in the direction of their respective branches (FIG. 5), a section of a coil 1 to be bound may be inserted between them. When these two portions 3A, 3B are brought together with their internal faces 5A, 5B coming into contact and sliding over each other, the pairs of branches $6A_1$ - $6B_1$ and $6A_2$ - $6B_2$ together with the junction zones 7 and 8 delimit a central opening 9 (FIG. 6).

This central opening 9 has two opposite curved ends 10, 11 one of which is situated on the portion 3A (end 10) and the other on portion 3B (end 11), in the junction zones 7 and 8. This central opening 9 also has two opposite straight sides 12 and 13 each of which is constituted by one of the branches of the first portion together with one of the branches of the second portion (the branches $6A_1$ and $6B_1$ for the side 12 and the branches and $6A_2$ and $6B_2$).

By sliding the internal faces 5A and 5B over each other, the guide device in accordance with the invention can have a central opening 9 of variable size starting from a first extreme relative position of the two portions 3A and 3B in which the curved ends 10 and 11 meet each other and delimit a substantially circular opening (which minimum sized opening could be completely circular if each end 10, 11 is itself a semicircle). In a second extreme relative position, the internal faces 5A, 5B are in contact only at their end portions and a highly elongate oblong central opening 9 is obtained, with the curved ends 10, 11 being interconnected by two straight sides 12, 13 of maximum length. Any intermediate length can be provided.

In the device in accordance with the invention, the guide channel 4 is hollowed out alternately in one and then in the other of the internal faces 5A and 5B of the two portions 3A and 3B.

In each of the junction zones 7, 8 the guide channel is necessarily hollowed out in the parts of the portions 3A and 3B which constitute the ends 10, 11 of the central opening 9. In the first portion 3A there is a first quarter circle length 4A (FIGS. 3 and 5) which is open towards the interior of the central opening 9 on the curved end 10. On reaching the branch $6A_1$, the first length 4A moves away from the straight edge 12. It is advantageously a quarter circle that is tangential to the curved end 10, but of larger radius of curvature. The first length comes to an end on entering the branch $6A_1$ in the direction of the arrow $F_1$ on the path of the binder wire being pushed through the channel 4. It ends in the branch $6A_1$ by a slope 14 which rises to the level of the internal face 5A. The slope 14 provides the connection to a straight second length 4B hollowed out of the internal face 5B of the branch $6B_1$, which face is slidable over the face 5A of the branch $6A_1$. On arriving at the junction zone 8, the second length 4B is continued by a semicircular third length 4C which is tangential to the curved edge 11 and which is open towards the interior of the central opening 9. On reaching the branch $6B_2$, the third length 4C moves away from the straight edge 13 and ends in a slope 15 rising to the level of the internal face 5B. The slope 15 provides the connection to a fourth length 4D hollowed out in the face 5A of the straight branch $6A_2$ of the first portion 3A. On arriving at the junction zone 7, the fourth length 4D is followed by a fifth length 4E which is a quarter circle, which is tangential to the end 10 and which is open to the inside of the central opening 9.

The first length 4A communicates with a straight inlet channel 16 in the direction $F_1$ along which the binder wire arrives. The fifth length 4E ends in a straight outlet channel 17 in the direction $F_2$ along which the binder wire leaves. The straight channels 16, 17 are in correspondence with the channels in the binder head 2, or preferably, as explained above, they form part of the head.

Regardless of the length given to the central opening 9 by sliding over each other the internal faces 5A and 5B of the two portions 3A and 3B, the binder wire is always properly guided in the direction $F_1$ to $F_2$ through all the successive lengths 4A to 4D of the guide channel 4. The curved ends 10, 11 of the central opening 9 may be put into contact with the articles to be bound, as shown in FIG. 6. In other words, the binder wire is itself put into contact in the junction zones 7 and 8 with the articles to be bound, regardless of the length given to the central opening 9, As a result, the binder wire has practically no excess length relative to the perimeter of the articles to be bound.

Figure 4:
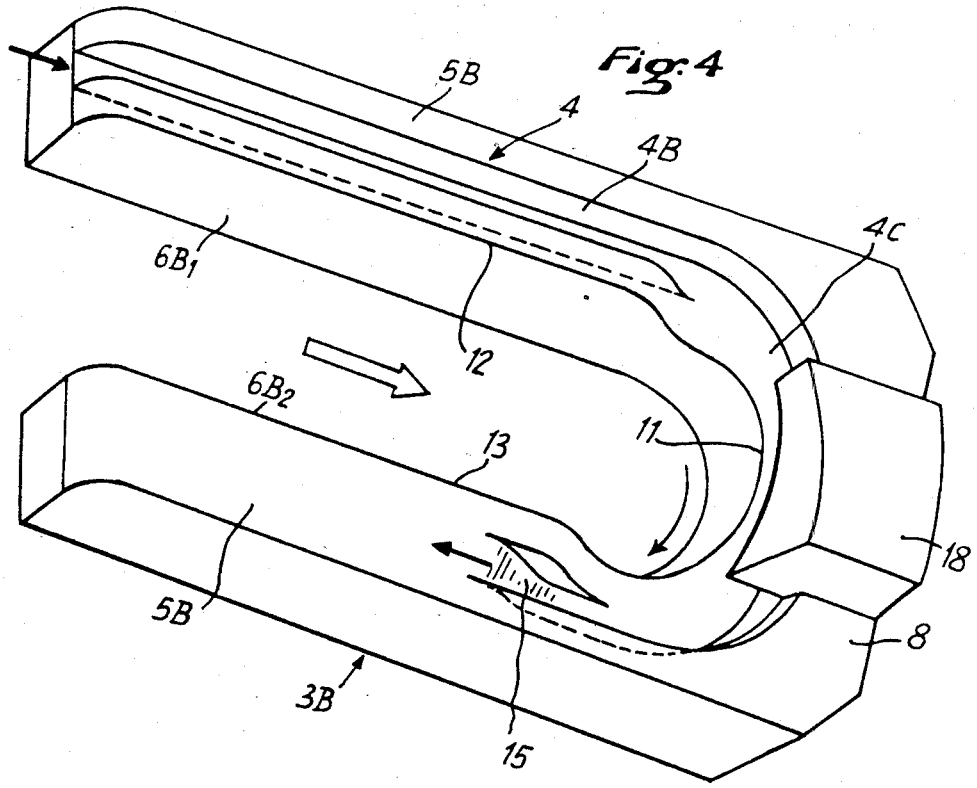

It will be observed in FIG. 4, that in the junction zone 8, in the gap between the branches $6A_1$ and $6A_2$ of the first portion 3A, the second portion 3B is of extra thickness at 18 to provide an outward limit on the length 4C of the channel 4. In the straight lengths 4B, 4C the channel 4 is limited by the corresponding opposite internal face of the branches of the opposite portion.

On the curved end 10 of the first portion 3A, the two quarter circle lengths 4A and 4E are not in the same plane. They are offset perpendicularly to the plane of FIG. 5 so that the inlet and outlet channels 16 and 17 are separated by a distance equal to the diameter of the binder wire.

I claim:

1. A device for guiding a binder wire around articles to be bound, characterized in that it comprises a first portion (3A) having an internal face (5A), a second portion (3B) having an internal face (5B), a guide channel (4) hollowed out in said internal faces (5A, 5B), each portion (3A, 3B) having two parallel branches ($6A_1$, $6A_2$ and $6B_1$, $6B_2$ respectively) extending towards one another from two respective opposite junction zones (7, 8), said branches being capable of having their internal faces (5A, 5B) slide over each other and delimiting a central opening (9) having curved ends (10, 11) in the junction zones and straight sides (12, 13) in the parallel branches ($6A_1$ - $6A_2$ and $6B_1$ - $6B_2$), while the guide channel (4) is composed of successive lengths (4A to 4E) hollowed alternately in the internal face (5A) of one portion (3A) and then in the internal face (5B) of the other portion (3B) with connecting slopes (14, 15) between each internal face and the opposite internal face.

2. A device according to claim 1, characterized in that in the junction zones (7, 8) of the branches ($6A_1$-$6A_2$, and $6B_1$-$6B_2$) of each of the portions (3A, 3B), the lengths (4A, 4C, 4E) of the guide channel (4) are hollowed out in proximity to the corresponding curved end edge (10, 11) are are each open towards the interior of the central opening (9).

3. A device according to claim 2, characterized in that the lengths (4A, 4C, 4E) in the junction zones (7, 8) are in circular arcs and are respectively tangential to the curved ends (10, 11) of greater radius of curvature.

4. A device according to claim 1, characterized in that the guide channel (4) includes two lengths (4A, 4C) respectively hollowed out from the junction zones (7, 8) of each of the portions (3A, 3B) each of which lengths, on arriving at the corresponding branch ($6A_1$-$6B_2$) going in the direction $F_1$ in which the binder wire passes through the guide channel (4), ends in a slope (14, 15) rising to the internal face (5A, 5B) to connect with the following length (4B, 4D) which is hollowed out in the internal face of the branch ($6B_1$, $6A_2$) of the other portion.

5. A device according to claim 2, characterized in that in the branches ($6A_1$-$6A_2$, $6B_1$-$6B_2$) of the two portions (3A, 3B), the guide channel (4) is spaced away from the straight sides (12, 13) of the central opening (9).

* * * * *